US011808559B2

(12) United States Patent
Brown et al.

(10) Patent No.: US 11,808,559 B2
(45) Date of Patent: Nov. 7, 2023

(54) TAMP FOR EXPLOSIVE MATERIAL

(71) Applicant: River Front Services, Inc., Chantilly, VA (US)

(72) Inventors: Anthony Miles Brown, Sneads Ferry, NC (US); Donald Ray Brown, Oakton, VA (US)

(73) Assignee: RIVER FRONT SERVICES, INC., Chantilly, VA (US)

( * ) Notice: Subject to any disclaimer, the term of this patent is extended or adjusted under 35 U.S.C. 154(b) by 192 days.

(21) Appl. No.: 17/190,321

(22) Filed: Mar. 2, 2021

(65) Prior Publication Data

US 2021/0270589 A1 Sep. 2, 2021

Related U.S. Application Data

(60) Provisional application No. 62/984,104, filed on Mar. 2, 2020.

(51) Int. Cl.

| | |
|---|---|
| ***F42D 1/08*** | (2006.01) |
| ***F42D 1/20*** | (2006.01) |
| ***F42D 1/24*** | (2006.01) |
| *F42B 3/087* | (2006.01) |

(52) U.S. Cl.

CPC ..... *F42D 1/20* (2013.01); *F42D 1/08* (2013.01); *F42D 1/24* (2013.01); *F42B 3/087* (2013.01)

(58) Field of Classification Search

CPC ..... F42D 1/08; F42D 1/20; F42D 1/24; F42B 3/087

USPC ..... 102/304, 333

See application file for complete search history.

(56) References Cited

U.S. PATENT DOCUMENTS 3,760,728 A * 9/1973 McKee ..... F42B 3/087 102/324
3,791,297 A * 2/1974 McKee ..... F42B 3/087 102/317
3,837,280 A * 9/1974 Lewer ..... F42D 1/24 86/20.15

(Continued)

FOREIGN PATENT DOCUMENTS

CN 206225975 U 6/2017
GB 2108245 A 5/1983

(Continued)

OTHER PUBLICATIONS

"International Search Report & Written Opinion in PCT International Application No. PCT/US2021/020540 filed Mar. 2, 2021", dated Nov. 24, 2021, 14 pages.

*Primary Examiner* — James S Bergin
(74) *Attorney, Agent, or Firm* — Johnson, Marcou, Isaacs & Nix, LLC

(57) ABSTRACT

This description relates to a tamp for an explosive. The tamp is formed from heat-shrink material having its ends heat-shrunk closed holding a tamp substance therein. A length of heat-shrink material is provided. A first end of the heat-shrink material is heated-shrunk closed to create a bag shape. A tamp substance is inserted into the bag via a second end of the heat-shrink material. The second end of the heat-shrink material is heat-shrunk closed to create a tamp. The tamp is placed adjacent to an explosive. This description also relates to a sleeve for an explosive. The sleeve is formed from heat-shrink material. An explosive is placed in the sleeve. One or both ends of the sleeve may be heat-shrunk closed.

19 Claims, 8 Drawing Sheets

(56) References Cited

U.S. PATENT DOCUMENTS

| | | | | | |
|---|---|---|---|---|---|
| 4,036,138 | A | | 7/1977 | Chopra | |
| 4,422,382 | A | * | 12/1983 | Marz | F42B 3/00 86/20.12 |
| 4,790,890 | A | | 12/1988 | Miller | |
| 5,009,163 | A | | 4/1991 | Robins | |
| 6,321,630 | B1 | | 11/2001 | Woodall | |
| 7,299,735 | B2 | | 11/2007 | Alford | |
| 2011/0197779 | A1 | | 8/2011 | Moore | |

FOREIGN PATENT DOCUMENTS

| | | | | | |
|---|---|---|---|---|---|
| IE | 44870 | B1 | * | 4/1982 | B65D 75/68 |
| WO | 0026024 | A1 | | 5/2000 | |
| WO | 2007099359 | A1 | | 9/2007 | |

* cited by examiner

TAMP FOR EXPLOSIVE MATERIAL

CROSS REFERENCE TO RELATED APPLICATIONS

This application claims priority to U.S. Provisional Patent Application No. 62/984,104 filed Mar. 2, 2020 and titled "High Pressure Tamp for Explosive Material." The entire contents of the above-identified priority application are hereby fully incorporated herein by reference.

TECHNICAL FIELD

The technology described herein relates to a tamp that is used to cover explosive material prior to detonation.

BACKGROUND

Conventional tamps are usually by-products of other activities and are formed of a thin, clear polyolefin/polyurethane plastic material or hard ABS plastic. For example, polyurethane water bottles and polyolefin medical intravenous (IV) bags are commonly used as tamps.

Medical IV bags made of a highly elastic polyolefin are immediately consumed by an explosion, and therefor do not create a fragmentation hazard from the tamp itself. However, the tamp effect is created purely by the weight and volume of water in the bag. Also, the material holding the water does not add any value to the tamp because the material cannot hold up to the effects of the explosion, for example, heat and pressure. Medical IV bags are pre-formed in standard sized and pre-filled with standard quantities of fluid. These types of conventional tamps are hard to transport because they are fragile, are highly susceptible to puncture or tear, and are heavy because the amount of water is preset, cannot be adjusted, and must be transported full of water.

Conventional tamps also can be formed from solid or stiff materials. However, these conventional tamps create fragmentation or projectile hazards during an explosion. For instance, ABS plastic, high density polyurethane rubber, or even conveyor belt rubber has long been a valued tamping material. These materials stand up to the effects of explosions, such as heat and pressure, very well, especially in the case of conveyor belt or high-density polyurethane. However, these materials are just as well known for their threat of projectile hazard. While they work well for concentrating and directing the explosion, they do not stay on the explosion very long. Additionally, they do not provide any support in containing a fire and become a dangerous projectile that must be accounted for in the tactics and use. These conventional solid/stiff tamps quickly fly away from an explosion intact or in fragmented pieces. Hard plastic bottles also can be used and are sold regularly to support tamping material on many breaching websites. While plastic bottles try to make the best of water or other materials for tamping, they have significant drawbacks as well. Similar to high density polyurethane or other more durable materials, plastic water bottles create significant fragmentation or projectile hazards and do not stay on the explosion sufficiently. They also are heavy, awkward to work with, non-flexible, and are susceptible to damage in transportation, which makes these items a less attractive option for tamping.

SUMMARY

This description relates to a tamp for an explosive. The tamp is formed from heat-shrink material having its ends heat-shrunk closed holding a tamp substance therein. A length of heat-shrink material is provided. A first end of the heat-shrink material is heated-shrunk closed to create a bag shape. A tamp substance is inserted into the bag via a second end of the heat-shrink material. The second end of the heat-shrink material is heat-shrunk closed to create a tamp. The tamp is placed adjacent to an explosive. This description also relates to a sleeve for an explosive. The sleeve is formed from heat-shrink material. An explosive is placed in the sleeve. One or both ends of the sleeve may be heat-shrunk closed.

These and other aspects, objects, features, and advantages of the invention will become apparent to those having ordinary skill in the art upon consideration of the following detailed description of illustrated examples.

DETAILED DESCRIPTION

The technology described herein relates to a tamp that is used to cover explosive material prior to detonation. A simple example is a long, thin piece of explosive material is placed next to a substrate that is to be breached, such as a wall, window, roof, or door. The tamp is filled with water or another tamp substance and then placed over the explosive material. Upon detonation, the tamp helps momentarily contain the rapidly expanding explosive gases, concentrating the effect of the explosive on the substrate. The tamp also may help with fire prevention, depending on the tamp substance type, by allowing the explosive gases to reach maximum expansion within the tamp substance that is contained in the tamp. Example tamp substances include water, gelatin, or other substance or combinations of substances. The tamp substance helps contain and extinguish the fireball of the explosion while helping direct the explosive force to the substrate.

The technology described herein includes using heat-shrink tubing or sheeting as a tamp and explosive compression sleeve in an explosive system. The heat-shrink tubing is sealed on both ends to hold a tamping substance, thereby creating an explosive tamp. Additionally, or alternatively, an explosive may be placed inside heat-shrink tubing, and the heat-shrink tubing is sealed on both ends to create an explosive sleeve holding the explosive.

Typically, heat-shrink tubing is used in insulating and/or waterproofing electrical cable and connections. The heat-shrink tubing is placed around bare wire or other electrical components, typically, around an electrical connection. Heat is applied to the material of the heat-shrink tubing, and the material shrinks and conforms to cover evenly around the electrical connection, thereby adding an insulating layer to the connection. Certain heat-shrink tubing has two or more layers, such as an outer layer and an inner layer. The outer layer comprises a puncture resistant, flexible, and heat-activated material with the consistency of rubber tubing, similar to single-layer heat-shrink tubing. The inner layer comprises a heat-activated sealant, glue, adhesive, or other suitable material. When heated with the outer layer of the heat-shrink tubing, the heat-activated inner layer flows around the wire or electrical connection inside the outer heat-shrink tubing. As it cools, the heat-activated inner layer can waterproof an electrical connection, seal the outer layer to itself or to anything in contact with the inner layer, and/or seal the ends of the outer heat-shrink tubing around the wire or connection.

Tamps according to various aspects of the technology discussed herein will now be described. Tamps can be formed using single layer heat-shrink tubing or multiple layer heat-shrink tubing.

Figure 1:
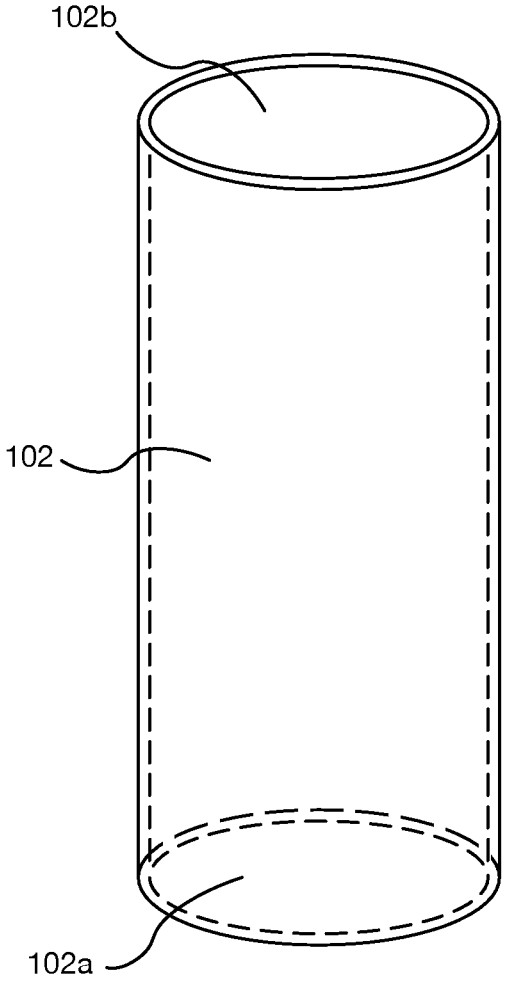
FIG. 1 is a perspective view of a length of single layer heat-shrink tubing for an explosive tamp, wherein the heat-shrink tubing is unheated, in accordance with certain examples.
Figure 2A:
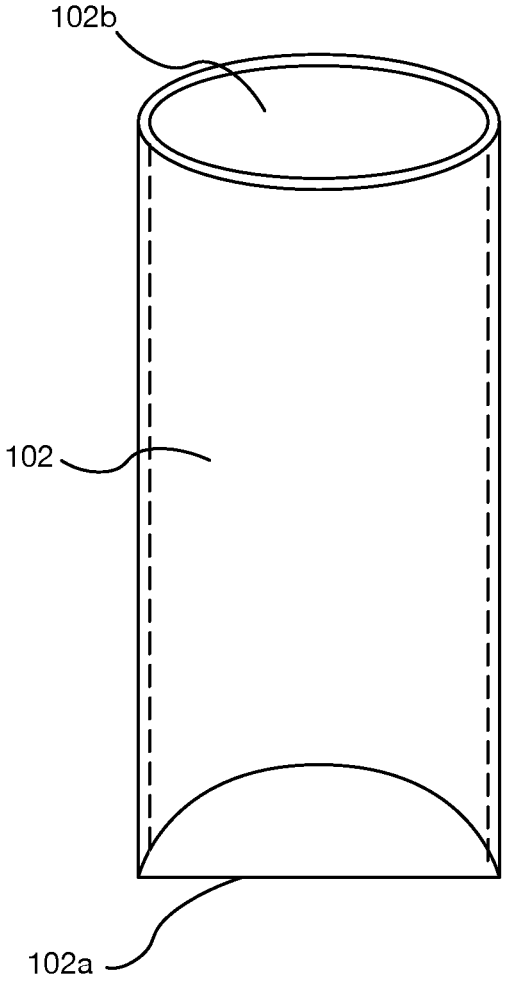
FIG. 2A is a perspective view of the single layer heat-shrink tubing depicted in FIG. 1 and having a first end closed via heat application, in accordance with certain examples.
Figure 2B:
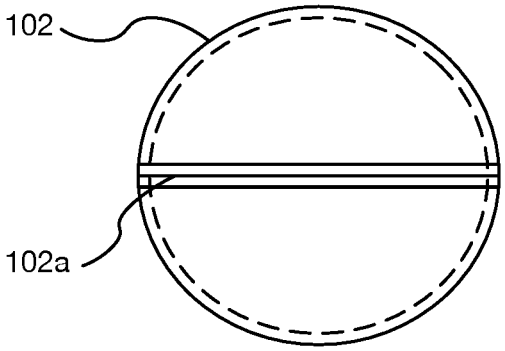
FIG. 2B is a bottom view of the single layer heat-shrink tubing depicted in FIG. 2 showing the closed end, in accordance with certain examples.
Figure 3:
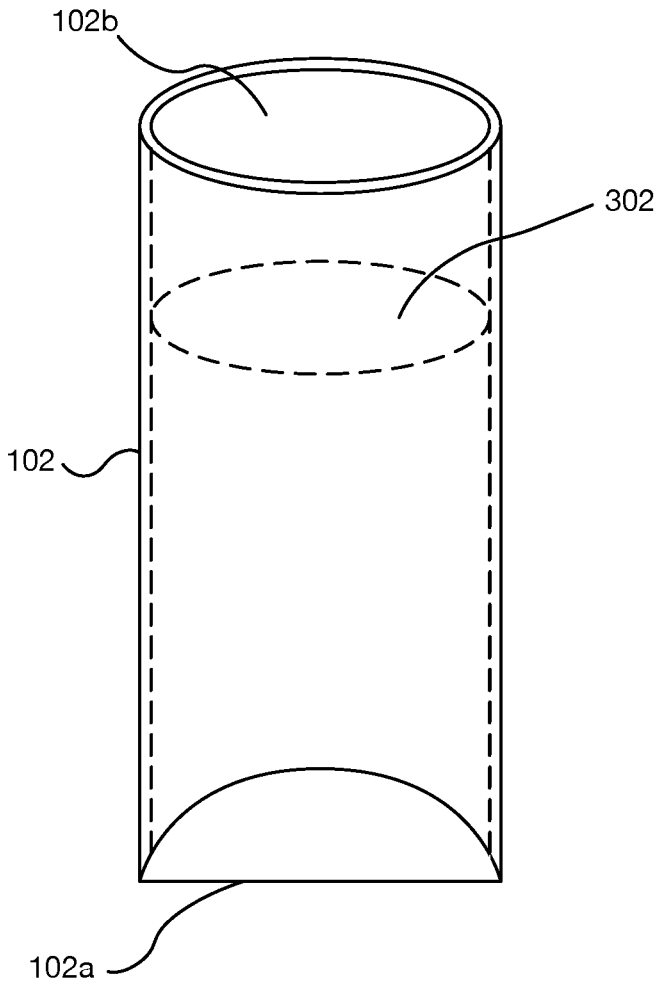
FIG. 3 is a perspective view of the single layer heat-shrink tubing depicted in FIG. 2 and being filled with a tamping substance, in accordance with certain examples.
Figure 4:
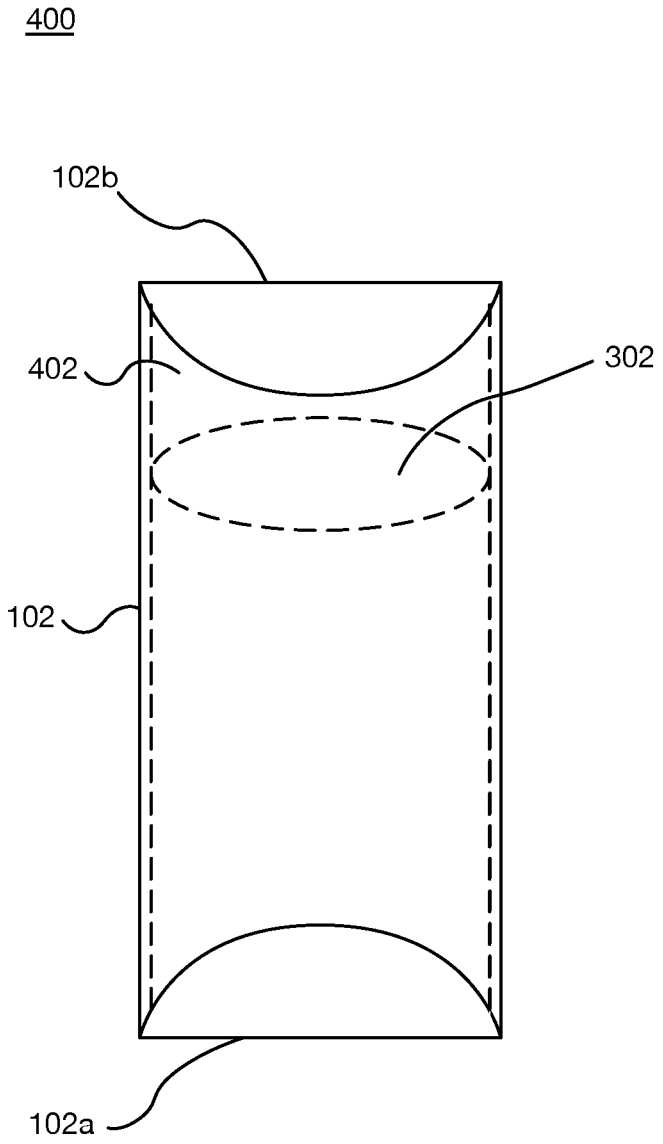
FIG. 4 is a side view of the single layer heat-shrink tubing 102 depicted in FIG. 3, filled with a tamping substance, and having a second end closed via heat application, thereby creating an explosive tamp, in accordance with certain examples.

With reference to FIGS. 1-4, an explosive tamp formed using a single layer of heat-shrink tubing will be described. FIG. 1 is a perspective view of a length of single layer heat-shrink tubing 102 for an explosive tamp, wherein the heat-shrink tubing 102 is unheated, in accordance with certain examples. FIG. 2A is a perspective view of the single layer heat-shrink tubing 102 depicted in FIG. 1 and having a first end 102*a* closed via heat application, in accordance with certain examples. FIG. 2B is a bottom view of the single layer heat-shrink tubing 102 depicted in FIG. 2 showing the closed end 102*a*, in accordance with certain examples. FIG. 3 is a perspective view of the single layer heat-shrink tubing 102 depicted in FIG. 2 and being filled with a tamping substance 302, in accordance with certain examples. FIG. 4 is a side view of the single layer heat-shrink tubing 102 depicted in FIG. 3, filled with a tamping substance 302, and having a second end 102*b* closed via heat application, thereby creating an explosive tamp 400, in accordance with certain examples.

With continuing reference to FIGS. 104, the tamp 400 can be manufactured or otherwise fashioned in various sizes and lengths. A piece of heat-shrink tubing 102 (or a roll of tubing) for the tamp 400 is cut to a desired length. Alternatively, a sheet of heat-shrink material can be rolled and an overlapping seam of the roll can be sealed to create a tube or other desired shape.

A first end 102*a* of the tubing 102 is closed by applying heat (or heat and pressure) to the first end 102 of the tubing 102. The heat (or heat and pressure) fuse the first end 102*a* of the tubing to close the first end 102*a* of the tubing 102. The shape of the tubing 102 with the first end 102*a* closed may resemble a "bag." The open, second end 102*b* of the bag is filled with a desired amount of tamp substance 302. The closed, first end 102*a* of the bag holds the tamp substance 302 in the bag. Then, heat (or heat and pressure) are applied to the open, second end 102*b* of the tubing 102 to close the second end 102*b* of the tubing 102. In this manner, the tamp substance 302 is contained inside the tubing 102. The tubing with both ends 102*a*, 102*b* closed and containing the tamping substance 302 is a tamp 400. As shown in FIG. 4, an air gap 402 may be left inside the tamp 400, if desired. The air gap may not exist in certain tamps 400. Additionally, the volume of the tamp substance 302 and the volume of any air gap 402, if used, can be varied to provide different tamping effects, as desired or for a particular explosive application.

A multi-layer type of heat-shrink material/tubing also can be used to create the tamp 400. A multi-layer heat-shrink tubing includes may include two or more layers and includes at least an outer layer and an inner layer. The outer layer comprises a material similar to single-layer heat-shrink tubing, such as the tubing 102 depicted in FIGS. 1-4. The inner layer includes a heat-activated sealant, glue, adhesive (for example, a thermoplastic adhesive), or other suitable material (referred to herein collectively as a "sealant") coupled inside the outer layer of the multi-layer tubing. When heat is applied, the outer layer shrinks. When heated with the outer layer of the heat-shrink tubing, the heat-activated inner layer flows and melts together, thereby providing a waterproofing effect and better sealing the ends to hold the tamp substance. The outer layer comprises a standard heat-shrink material. The inner layer seals and waterproofs the bag/tubing of the explosive tamp.

Various technology for the explosive tamps are described previously and hereinafter. A particular tamp may incorporate one or more features of the described technology.

A high temperature resistant heat-shrink tubing or sheeting may be used as a material for a tamp. Particular qualities of the tubing or sheeting can be selected for a desired effect. A higher heat resistance can be selected to provide a material that does not rapidly melt, thereby holding the tamp material in place on the explosive for a prolonged time. In certain examples, the heat-resistant material is designed to withstand heat up to 120 degrees Celsius or more, such as 158 degrees Celsius, with full recovery. The ability of heat-shrink materials to expand prior to failure maintains the tamp on the explosion for a longer time, which increases the effectiveness of the explosive. The high temperature resistant heat-shrink material incurs a greater expansion prior to failure compared to less temperature resistant heat-shrink materials, which maintains the tamp on the explosion for an even longer time. This increased time on target may be microseconds, but that time has significant advantages and effects. Efficiency and impact are substantially improved, thereby reducing cost, material, and weight for each explosion. Conventional tamps typically do not expand prior to failure or have a minimal expansion prior to failure with minimal tamping effect.

A heavy-wall tubing or sheeting may be used as a material for a "no" fragmentation, high-pressure explosive tamp. This material has both a high tensile strength, for example, 1750 psi, and a high ultimate elongation prior to failure, for example, 200-400%, or specifically 350%. Therefore, this material does not come apart or fragment into pieces as easily, and also maintains the effect of the tamp longer at the site of the explosion. Additionally, once the material does fail and becomes a projectile, the light-weight aspect causes it to fall quickly to the ground, thereby minimizing any projectile hazard effect from the tamp.

A two-layer, waterproof-type of heat activated sealant and heat-shrink material may be used as a high-strength material for a "high-pressure" tamp. This material allows easy sealing of the ends of the tamp. The sealing makes the tamp more durable and also able to operate at higher pressure. Therefore, the tamp can be designed for specified situations and can withstand a more rugged environment without special handling. For example, specified amounts of tamping substance can be placed in the tamp for a specified amount of explosive and/or a specified target substrate. The sealed ends prevent leakage of the tamp substance from the tamp to maintain the desired effects of the tamp on the explosive. Additionally, the sealed ends allow the tamp to withstand a more rugged environment prior to use.

Any suitable tamp substance may be used to fill the bag/tubing of the tamp. For example, water, sand, gelatin, non-Newtonian fluids, or any other suitable substance may be used to fill the bag/tubing. The substance may be chosen to provide a desired effect in the explosive system (for example, water may provide a desired fireball dampening effect, or certain substances may provide a more effective explosion on the target).

Closing the ends of the tubing contains the tamp substance within the tubing. Depending on the tamp substance and/or the desired effect of the tamp, the ends of the tubing may or may not be completely sealed when closed. For example, the closed ends of the tubing may hold a sand or gelatin tamp substance even if the closed ends are not completely sealed. The ends of the tubing may be completely sealed to contain other tamp substances, such as water. Additionally, sealing the ends of the tubing creates a high-pressure tamp that further enhances benefits of the technology described herein. The sealed ends of the high-pressure tamp do not allow the tamp material to escape until the heat-shrink material of the tubing is breached due to detonation of the adjacent explosive, due to expansion of the tamp substance from heat generated by the detonation, and/or due to contraction of the heat-shrink tubing from heat generated by the detonation.

While the ends of the tamp are "heat-shrink" fused, the length of the bag between the ends may or may not be "heat-shrunk" prior to the explosion. Heat from the explosion shrinks the tamp around the tamp substance, thereby increasing the pressure around the tamp substance and providing further structural benefits of a high-pressure tamp. As the high-pressure tamp shrinks around the tamp substance, the tamp and tamp substance resistance to the explosion increases. The pressure and resistance of the high-pressure tamp to the expanding gases increase as heat shrinks the high-pressure tamp. This increase of pressure on the tamp substance, directly correlates to the effect on the target being attacked. The non-high-pressure tamp also may achieve certain of these benefits, although with a reduced effect.

A typical material for the heat-shrink tubing or material is polyolefin. Conventional medical intravenous (IV) bags may be made from polyolefin, but such bags are very thin and weak. Properties of heat-shrink tubing/material are very different compared to medical bags, and such properties can be designed or otherwise chosen to achieve the desired effects described herein. Heat-shrink tubing or other material comprises a stronger material, is less susceptible to damage prior to an explosion, and provides the benefits described herein during the explosion.

Heat-shrink tubing is manufactured in many varieties and chemical makeups. Heat-shrink tubing is typically manufactured from a thermoplastic material, such as polyolefin, fluoropolymer (such as FEP, PTFE, PVDF, or Kynar), PVC, neoprene, or silicone elastomer. The manufacturing process induces a memory in the tubing so that the tubing is able to shrink back to original, extruded dimensions upon heating. Heat-shrink tubing is rated by its expansion ratio, which is a comparison of the differences in expansion and recovery rate. Any suitable type of heat-shrink material/tubing may be chosen to achieve desired results and for desired applications or explosives. A particular tubing may be chosen for its expansion ratio and/or its material type.

The explosive tamps described herein have many significant and unexpected benefits over conventional tamps. For example, the heat-shrink material utilized in the tamp has a significant increase in material strength compared to conventional tamp materials. For example, in some instances, an adult can stand on a sealed tamp or, in some cases jump on it, and the tamp will not leak. The tamps described herein also resist puncture and can be transported with less risk of damage or failure prior to use. Conventional medical IV bags are very thin and weak and would fail under significantly less stress.

The tamps described herein can reduce the amount of needed explosive material by up to 25%, 30%, 40%, or more compared to conventional bags/bottles or gelatins used as tamps. This reduction results in significant cost savings, significant weight savings for transporting explosives, and significant safety increases related to less explosive. For an individual carrying the explosive material, this weight reduction is significant. The stronger tamp material provides a prolonged effect of the explosive on the target, thereby reducing the amount of explosives needed. Additionally, since the length of the tamp is not heat-shrunk prior to the explosion, in certain applications, heat from the explosion shrinks the tamp to further strengthen the tamp and to further force the explosive gases on the target. The ability of heat-shrink materials to expand prior to failure also maintains the tamp on the explosion for a longer time, which increases the effectiveness of the explosive gases on the target. Overall, the explosion is contained on the target for a longer period of time compared to conventional tamps, which increases the effect of the explosive material on the target and decreases the amount of the explosive material needed for the desired effect. This increased time on target may be microseconds, but that time has significant advantages and effects. Efficiency and impact are substantially improved, thereby reducing cost, material, and weight for each explosion.

Containing the explosion on the target for a longer period of time, even for microseconds, can reflect the shockwave back towards the detonation products. In this case, the temperature and pressure rise, changes to pressure waves occur, and the potential for extra reactions occurs. This action can contribute to additional blast pressures, resulting in more efficient explosion effects.

The heat-shrink tubing and tamp substance combination used in the explosive tamps described herein does not come apart or fragment into pieces as easily, which reduces high-speed projectiles produced during an explosion. For example, the heat-shrink tubing eventually melts/fails at one or more locations. Because of the flexibility of the heat-shrink material and the explosive absorption of the tamping substance, any remaining portions of the tamp, particularly portions of the heat-shrink tubing, typically are not propelled more than a few feet from the explosion. Once the material does fail and becomes a projectile, the light-weight aspect causes it to fall quickly to the ground, thereby minimizing any projectile hazard effect from the tamp.

The explosive material used in the explosive system can comprise any suitable explosive material. For example, the explosive material may comprise detonation cord, HMX, RDX, C-4, or any other suitable explosives.

Tamps using the technology described herein can be made for later use. Alternatively, the tamps can be made at, or closer to, the target. Making the tamps at, or closer to, the target can reduce the shipping or carry weight of the tamp.

If the tamping substance, such as water, is available at, or closer to, the target, then the tamps can be made at or near the target and then used. In this case, the tamps can be carried empty and then made at or near the target with the available tamping substance. In contrast, conventional medical IV bags are filled with fluid from the factory and must be transported full to the target site. Additionally, conventional tamps made from solid/stiff materials are heavy and not compact.

Figure 5:
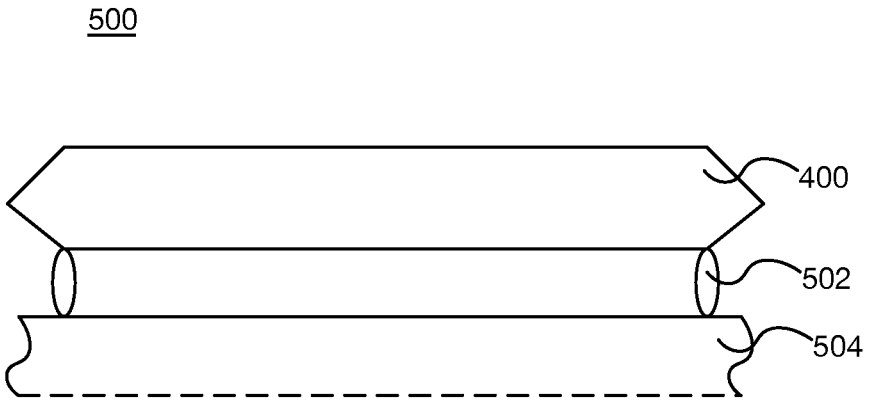
FIG. 5 is an illustration depicting an explosive system, in accordance with certain examples.

FIG. 5 is an illustration depicting an explosive system 500, in accordance with certain examples. The explosive system 500 includes an explosive tamp 400 and an explosive 502. In operation, the explosive 502 is placed next to a substrate 504 that is to be breached or otherwise exposed to an explosion. The substrate 504 may be any desired structure, such as a wall, window, roof, door, trunk, box, or other structure. The tamp 400 is placed over the explosive 502. The tamp 400 can be adhered to, or positioned to cover at least partially, the explosive 502. The tamp 400 can be laid over the explosive 502. For example, if the substrate 504 is situated horizontally or at a sufficiently small angle to prevent slipping, the tamp 400 can be laid over the explosive 502. Alternatively, the tamp 400 can be secured to explosive 502 with wire, rope, cord, adhesive, tape, glue, wrap, a brace or supporting pole/structure, or other suitable securing component. The tamp 400 can include one or more of the features described herein. The explosive 502 can be secured to the substrate 504, and then the tamp 400 can be secured to the explosive 502. Alternatively, the tamp 400 can be secured to the explosive 502, and then that combination can be secured to the substrate 504.

Figure 6:
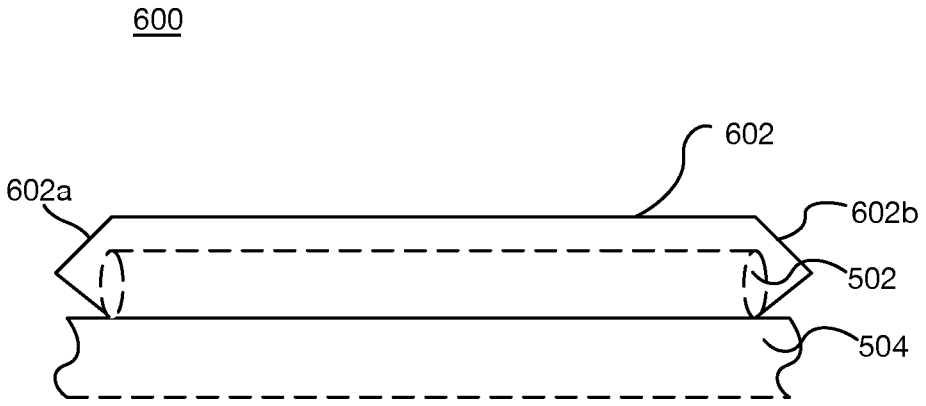
FIG. 6 is an illustration depicting an explosive system, in accordance with certain examples.

FIG. 6 is an illustration depicting an explosive system 600, in accordance with certain examples. The explosive system 600 includes an explosive sleeve 602 and an explosive 502. The explosive sleeve 602 comprises any of the heat-shrink tubing or sheeting described herein. The explosive 502 is placed inside the heat-shrink tubing. Ends 602*a*, 602*b* are heat-shrink closed to create the explosive sleeve 602 with the explosive 502 inside. Alternatively, one end 602*a* of the heat-shrink tubing may be heat-shrink closed, the explosive 502 may be inserted into the heat shrink tubing, and then the other end 602*b* of the heat-shrink tubing may be heat-shrink closed to create the explosive sleeve 602 with the explosive 502 inside. As shown in FIG. 6, the explosive sleeve 602 can be placed next to a substrate 504 that is to be breached or otherwise exposed to an explosion.

The explosive system 600 can increase efficiency of the explosion even without using the tamp 400. The sleeve 602 is effective to maintain the explosive gases on the target for an additional time period, compared to using the explosive 502 without the sleeve 602. This longer time period can have significant and unexpected results, similar to those achieved with the tamp 400 and as described herein. The sleeves described herein can reduce the amount of needed explosive material by up to 15-25% or more compared to not using the sleeve or compared to conventional bags/bottles or gelatins used as tamps. This reduction results in significant cost savings, significant weight savings for transporting explosives, and significant safety increases related to less explosive. For an individual carrying the explosive material, this weight reduction is significant. The ability of heat-shrink materials to expand prior to failure maintains the explosion for a longer time, which increases the effectiveness of the explosive gases on the target. Overall, the explosion is contained on the target for a longer period of time than without the sleeve 602, which increases the effect of the explosive material on the target and decreases the amount of the explosive material needed for the desired effect. This increased time on target may be microseconds, but that time has significant advantages and effects. Efficiency and impact are substantially improved, thereby reducing cost, material, and weight for each explosion.

To achieve the highest performance, both ends 602*a*, 602*b* of the sleeve 602 can be sealed with the explosive 502 contained inside. However, benefits of this design can be achieved with only one end of the sleeve 602 closed or with neither end of the sleeve 602 closed.

Figure 7:
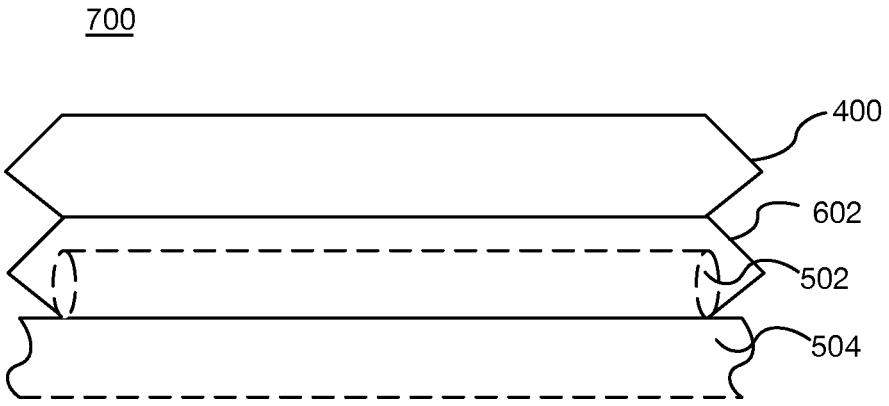
FIG. 7 is an illustration depicting an explosive system, in accordance with certain examples.

FIG. 7 is an illustration depicting an explosive system 700, in accordance with certain examples. As shown in FIG. 7, the tamp 400 can be combined with the explosive sleeve 602 to achieve combined benefits of the tamp 400 and the explosive sleeve 602.

The tamps and explosive sleeves described herein can be used with any suitable explosive. For example, typical explosives used for breaching include detonation cord (Det-cord), sheet explosive, and C-4 plastic explosive. The tamps and explosive sleeves can be used with these explosives or any other suitable explosive for breaching. Additionally, the tamps and explosive sleeves described herein are not limited to breaching applications and may be used with other types of explosives and for purposes other than breaching.

The example systems, methods, and components described in the embodiments presented previously are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation so as to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. A method to tamp an explosive, comprising:

providing a tubular length of heat-shrink material, the heat-shrink material comprising an elongated shape having a first end and a second end, the heat-shrink material encompassing a volume within the elongated shape between the first and second ends;

heating the first end of the heat-shrink material to close the first end of the heat-shrink material without heat-shrinking at least a portion of the heat-shrink material between the first and second ends;

inserting, via the second end of the heat-shrink material, a tamp substance into at least a portion of the volume encompassed by the heat-shrink material;

heating the second end of the heat-shrink material to close the second end of the heat-shrink material, without heat-shrinking the at least a portion of the heat-shrink material between the first and second ends, to thereby create a tamp; and placing the tamp adjacent to an explosive.

2. The method according to claim 1, wherein the heat-shrink material comprises heat-shrink tubing.

3. The method according to claim 1, wherein the heat-shrink material comprises an outer layer of heat-shrink material and an inner layer of sealant, wherein the inner layer of sealant melts to seal the first and second ends of the heat-shrink material when heat is applied to the first and second ends of the heat-shrink material, respectively.

4. The method according to claim 1, wherein the tamp substance comprises at least one of water, sand, gelatin, and non-Newtonian fluid.

5. The method according to claim 1, wherein placing the tamp adjacent to the explosive comprises adhering the tamp to the explosive.

6. The method according to claim 1, wherein placing the tamp adjacent to the explosive comprises coupling the tamp to the explosive.

7. The method according to claim 1, further comprising placing the explosive adjacent to a substrate.

8. The method according to claim 7, further comprising detonating the explosive.

9. The method according to claim 1, wherein heating the first end of the heat-shrink material further comprises applying pressure to the first end of the heat-shrink material.

10. The method according to claim 1, wherein heating the second end of the heat-shrink material further comprises applying pressure to the second end of the heat-shrink material.

11. The method according to claim 1, wherein the heat-shrink material comprises polyolefin.

12. A tamp for an explosive, comprising:

a tubular length of heat-shrink material comprising an elongated shape and having a first end and a second end, the first and second ends being heat-shrunk closed to create a volume within the heat-shrink material, at least a portion of the heat-shrink material between the first and second ends remaining unshrunk after closing the first and second ends; and a tamp substance disposed in the volume within the heat-shrink material.

13. The tamp according to claim 12, wherein the heat-shrink material comprises heat-shrink tubing.

14. The tamp according to claim 12, wherein the heat-shrink material comprises an outer layer of heat-shrink material and an inner layer of sealant, the inner layer of sealant sealing the first and second ends of the heat-shrink material when heat-shrunk closed.

15. The tamp according to claim 12, wherein the tamp substance filling at least a portion of the volume within the heat-shrink material comprises at least one of water, sand, gelatin, and non-Newtonian fluid.

16. The tamp according to claim 12, wherein the first and second ends of the heat-shrink material are compressed and heat-shrunk closed.

17. The tamp according to claim 12, wherein the heat-shrunk closed first and second ends are sealed.

18. The tamp according to claim 12, further comprising an explosive positioned adjacent to the tamp.

19. The tamp according to claim 12, further comprising an explosive coupled to an exterior of the heat-shrink material.

* * * * *